US005531647A

United States Patent [19]

Zelinski

[11] Patent Number: 5,531,647

[45] Date of Patent: Jul. 2, 1996

[54] BOWLING BALL

[76] Inventor: George Zelinski, 17311 McCarron Rd., Lockport, Ill. 60441

[21] Appl. No.: 518,261

[22] Filed: Aug. 23, 1995

Related U.S. Application Data

[63] Continuation of Ser. No. 430,270, Apr. 28, 1995, abandoned, which is a continuation of Ser. No. 237,327, May 3, 1994, abandoned, which is a continuation-in-part of Ser. No. 815,414, Dec. 31, 1991, abandoned.

[51] Int. Cl.[6] ..... A63B 37/04; A63B 37/06; A63B 37/10

[52] U.S. Cl. ..... 473/126

[58] Field of Search ..... 473/125, 126, 473/127, 128, 129, 130

[56] References Cited

U.S. PATENT DOCUMENTS

| | | | |
|---|---|---|---|
| 531,103 | 12/1894 | Dokkenwadel | 473/126 |
| 2,291,738 | 11/1940 | Luth et al. | 473/126 |
| 5,037,096 | 8/1991 | Pinel, Jr. et al. | 473/126 |
| 5,046,731 | 9/1991 | Zelinski | 473/126 |
| 5,074,553 | 12/1991 | Pawlowski et al. | 473/126 |
| 5,149,089 | 9/1992 | Zelinski | 473/126 |

*Primary Examiner*—George J. Marlo
*Attorney, Agent, or Firm*—Potthast & Ring

[57] ABSTRACT

A bowling ball (10) with a weight block assembly including a weight core (28), an annular weight block (22) surrounding the weight core (28) and a top weight block member (23) spaced, at least partly, from the annular weight block (22). In one embodiment (FIGS. 1, 1A) the top weight block (19) extends inwardly toward the center (16) and penetrates the weight core (28). In another embodiment (FIGS. 2 , 2A) the top weight block member (21) is spaced to the side of the annular weight block (20), while in the preferred embodiment, (FIGS. 3, 3A) the top weight block member (23) is aligned with the annular weight block member (22) and is located intermediate the annular weight block member (22) and the spherical surface (14) of the ball (10).

8 Claims, 3 Drawing Sheets

BOWLING BALL

This application is a continuation of Ser. No. 08/430,270, Apr. 28, 1995; which is a continuation of Ser. No. 08/237,327, Mar. 3, 1994; which is a continuation of Ser. No. 07/815,414, Dec. 31, 1991 all of which are abandoned.

BACKGROUND OF THE INVENTION

1. Field of the Invention

This invention relates generally to a bowling ball and, more particularly, to a bowling ball with an annular-like weight block member and an associated top weight block member.

2. Description of the Related Art Including Information Disclosed Under 37 CFR 1.97–1.99

Various weight blocks are known for redistributing the weight of a bowling ball to achieve desired dynamic characteristics.

In U.S. Pat. No. 4,121,828 issued Oct. 24, 1978, to Amburgey, one weight block configuration is a segment of an annular weight block within which a pair of radial spoke-like weight members are contained. Disadvantageously, there is no top weight block spaced from the annular weight block. Other configurations, such as shown in U.S. Pat. No. 4,286,034, issued May 19, 1981, to MacDonald, include weight blocks in the shape of a segment of a circle, but none of these circular segments are aligned with the center of the bowling ball or are associated with other weight blocks which are spaced from the annular segments. In U.S. Pat. No. 4,320,899, issued Mar. 23, 1982, to Salvino, annular segments are shown which are aligned with the center of the ball but which also lack any associated top weights spaced from the segments.

It is known in the art to locate weight blocks in a parallel relationship to the rolling plane of the ball to provide dynamic stabilization. This is found in U.S. Pat. Nos. 4,121,828 issued Oct. 24, 1978 to Amburgey and 4,183,527 issued Jan. 15, 1980 to Amburgey, as well. Further, in U.S. Pat. No. 4,268,034 issued May 19, 1981 to MacDonald, the weight block is placed on either side of the ball for positive or negative side weighting.

Thus, of all the known weight block distribution systems and methods, only the bowling ball shown in U.S. Patent of Amburgey employs a weight having an annular-like shape, i.e. an annular or other closed loop shape. While these two high density weights are embedded into the annular-like weight block for improved action, since they are in the form of radial spokes with no significant lateral extent transverse to the radius and with no portion of the spokes extending either into the core or outside of the annular-like weight block, it is believed the improvement in the degree of action and consistency and control of the action for different drilling positions is limited. In addition the density of the radial spokes is greater than, rather than equal to that of the core, in order to improve the action which disadvantageously precludes an integral construction. These density differentials are believed required because of the total containment of the radial spokes within the annular weight block with no part extending inwardly into the core or outwardly into the main body of the ball for increased effect.

SUMMARY OF THE INVENTION

It is therefore the principal object of the present invention to provide a bowling ball with improved action and controllability by the provision of an annular-like weight block with a top weight block which is at least partly spaced from the annular weight block.

Specifically, this objective is achieved through provision of a bowling ball having a spherical mass of preselected density and a spherical surface equidistant from a center of the spherical mass with a weight block assembly of a density greater than the preselected density comprising a substantially annular-like weight block member with a plane of symmetry substantially aligned with the center of the spherical mass and a top weight block member spaced, at least in part, from the annular-like weight block.

The objective is also achieved through provision of a bowling ball having a spherical mass of preselected density and a spherical surface equidistant from a center of the spherical mass with a weight block assembly of a density greater than the preselected density comprising an annular-like weight block member extending in a direction parallel to a plane of symmetry of the annular weight block and a top weight block member having a density greater than the annular-like weight block member and embedded in the annular-like weight block member and having an elongate dimension extending in a direction parallel to the plane of symmetry.

In one embodiment, the top weight block member is spaced from the plane of symmetry of the annular weight block member while in two other embodiments the top weight block member is aligned with the plane of the annular weight block. In one of the two other embodiments, the weight block is of a different density than the annular weight block and extends into the core surrounded by the annular weight block member. In another one of the aligned embodiments, the top weight block is preferably located intermediate the annular weight block member and the spherical surface of the ball.

BRIEF DESCRIPTION OF THE DRAWING

The foregoing objects and advantageous features of the invention will be explained in greater detail and others will be made apparent from the detailed description of the preferred embodiment of the present invention which is given with reference to the several figures of the drawing, in which.

DETAILED DESCRIPTION

Figure 1:
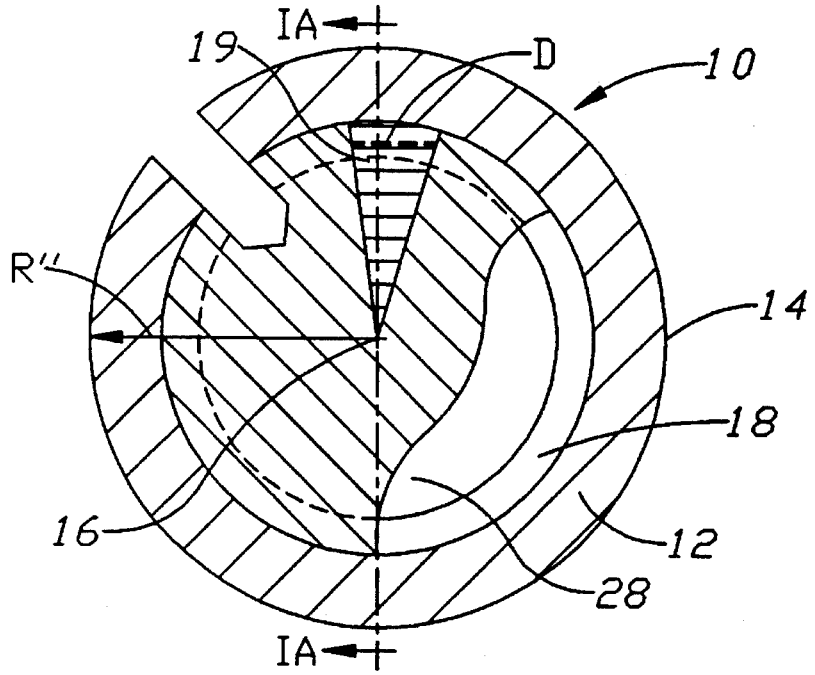
FIG. 1 is a side view, partially in section, of one embodiment of the bowling ball of the present invention in which an aligned top weight block extends a substantial amount from the annular-like weight block into the core.
Figure 2:
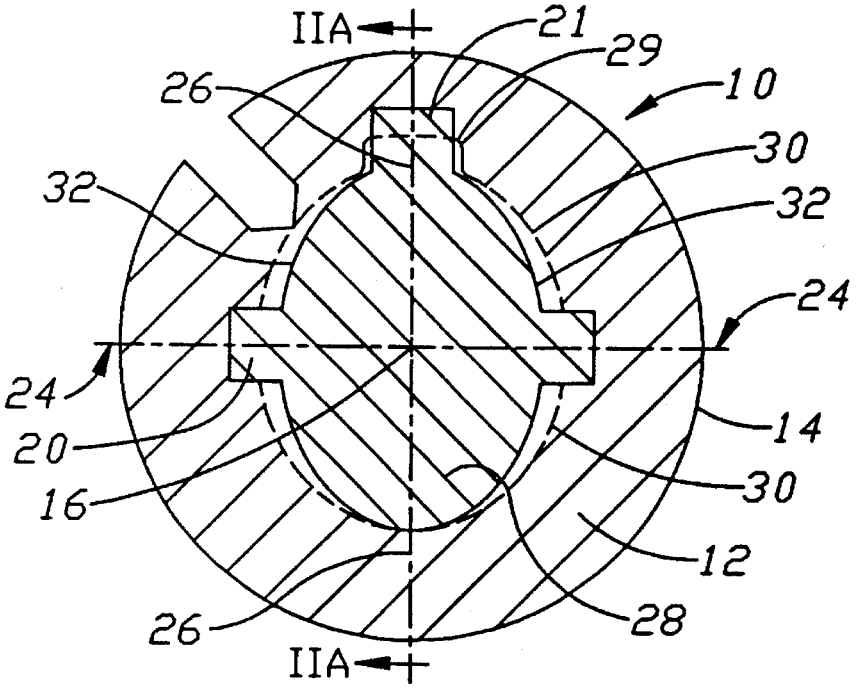
FIG. 2 is a sectional side view, of another embodiment of the bowling ball of the present invention in which the top weight block is spaced laterally from the plane of the annular-like weight block.
Figure 2A:
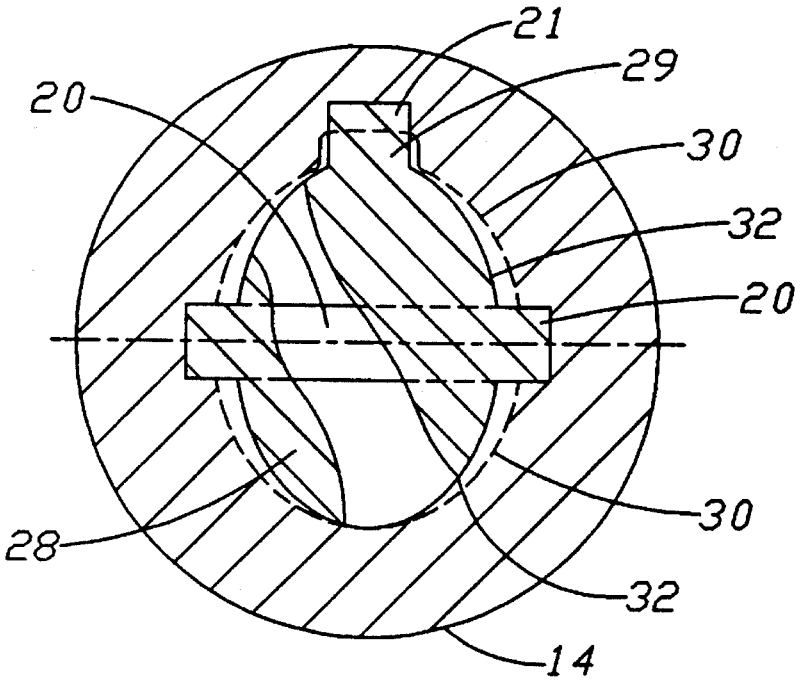
FIG. 2A is another sectional side view of the bowling ball of FIG. 2 taken along section line IIA—IIA of FIG. 2.
Figure 3:
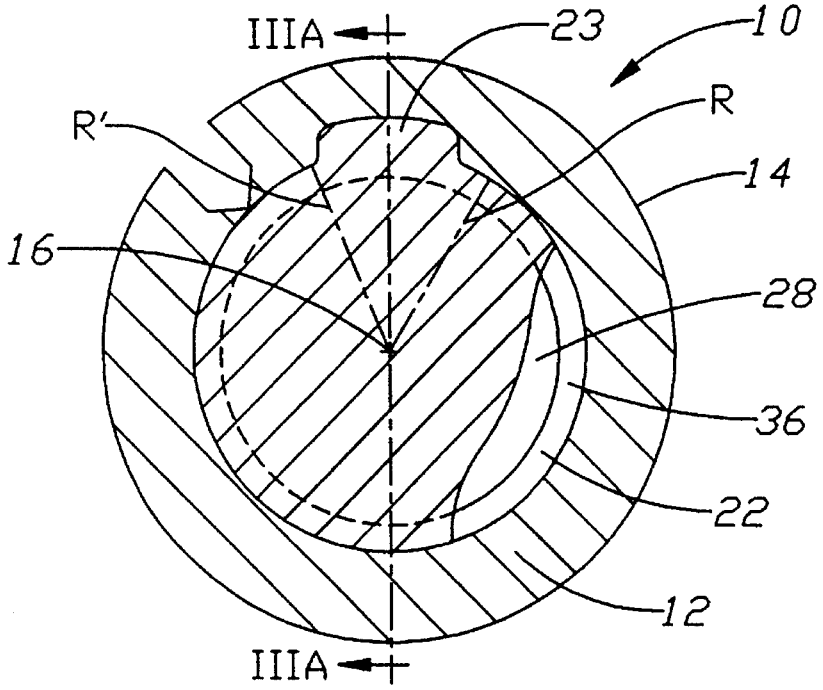
FIG. 3 is a side view, partially in section, of the preferred embodiment of the bowling ball of the present invention in which the top weight block is aligned with the plane of the annular-like weight block and extends outwardly from the annular weight block member.

Referring now to the drawings, in FIGS. 1, 2 and 3 is shown substantially a hemispheric cross sectional view of bowling ball 10 having a mass 12 of a preselected density, generally composed of polyurethane or the like. Ball 10 has a spherical surface 14 which is equidistant from center 16 of spherical mass 12.

Figure 1A:
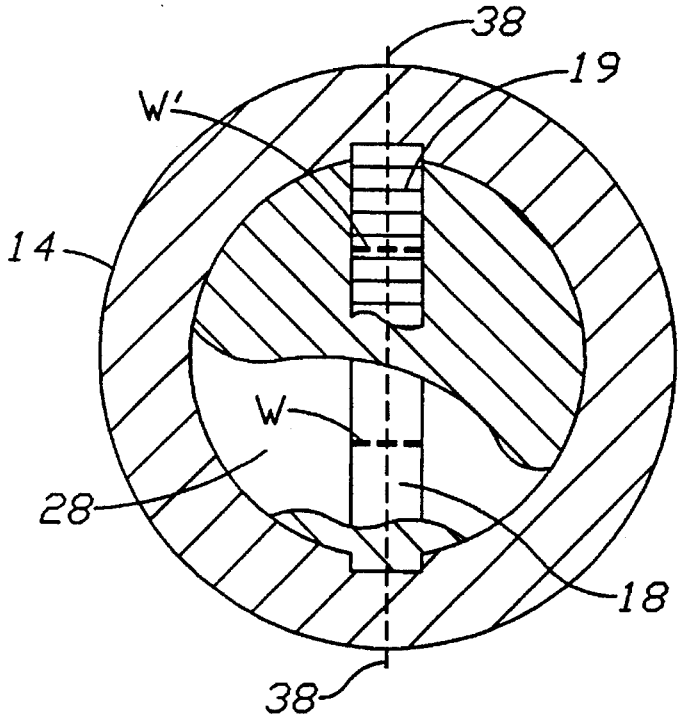
FIG. 1A is a sectional side view taken along section line IA—IA of FIG. 1.
Figure 3A:
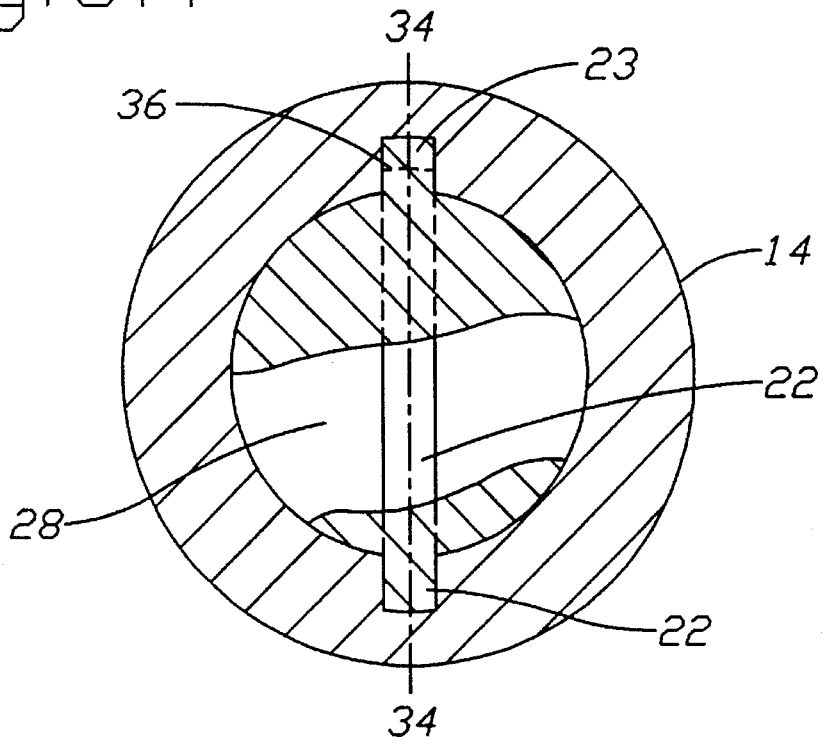
FIG. 3A is a sectional side view of the preferred embodiment of the bowling ball of the present invention taken along section line IIIA—IIIA of FIG. 3.

An improvement on bowling ball 10 is weight block 18 and 19 in FIG. 1 and 1A; 20 and 21 in FIG. 2 and 2A and 22 and 23 in FIG. 3 and 3A. These weight blocks have a density greater than the preselected density as described above. One portion of these weight blocks comprise substantially annular-like weight block members 18, 20 and 22. Each of these substantially annular-like weight block members have a plane of symmetry substantially aligned with center of spherical mass 16. The other portion of these weight blocks include top weight block members 19, 21 and 23 of FIGS. 1, 2 and 3 respectively. Each of these top weight blocks 19, 21 and 23 are spaced, at least in part, from annular-like weight block members 18, 20 and 22 respectively.

In FIGS. 2 and 3, top weight blocks 21 and 23 are located intermediate annular-like weight blocks 20 and 22 respectively and spherical surface 14 of the ball. Further, in the embodiment of FIG. 2, annular-like weight block 20 extends in a direction parallel to plane of symmetry 24 of annular-like weight block 20 with top weight block member 21 spaced from plane of symmetry 24. Top weight block member 21 is located along an axis 26 passing through center 16 of spherical mass 12 which is substantially transverse to annular-like weight block 20 plane of symmetry 24.

In FIGS. 1, 2 and 3, each embodiment has weight core 28 which is surrounded by annular-like weight block member 18, 20 and 22 respectively. Core 28 is generally composed of mineral filled polyester resin, or the like. The density of core is generally greater than that of spherical mass 12.

In the embodiment of FIG. 2, weight core 28 extends between top weight block member 21 and circular annular-like weight block 20 plane of symmetry 26. As can be seen by dotted lines in FIG. 2, weight core 28 can have two hemispherical sections 30 which extend from opposite sides of annular-like weight block member 20. Another configuration weight core 28 can be generally ovoid 32 in shape. As is seen in the embodiments of FIGS. 1 and 3 weight core 28 is generally spherical. It is further shown in FIG. 2 that top weight block member 21 take on various configurations including a cylindrical shape as seen as 21 and take on elongated shapes as seen in dotted lines 29.

In the embodiments of FIGS. 2 and 3 top weight block members 21 and 23 respectively have substantially the same density as annular-like weight block members 20 and 22 respectively. In both of these embodiments, and including the embodiment in FIG. 1, annular-like weight block members 18, 20 and 22 are each integral with their respective weight cores 28. Further in embodiments found in FIGS. 2 and 3 weight cores 28 are integral with top weight block members 21 and 23.

In the embodiment of FIG. 3, annular-like weight block member 22 extends in a direction parallel to plane of symmetry 34, as seen in FIG. 3A, of annular-like weight block member 22 and has top weight block member 23 aligned with plane of symmetry 34. Top weight block member 23 is located intermediate annular-like weight block member 22 and surface 14 of spherical mass 12. Weight core 28 is surrounded by annular-like weight block member 22. Weight core 28 in this embodiment can have two hemispherical sections which extend from opposite sides of annular-like weight block member 22 or take on other configurations such as an ovoid. Further, weight core 28 has a generally spherical shape. In this embodiment, top weight block 23 and annular-like weight block member 22 are integral.

In the embodiment in FIG. 3, annular-like weight block member 22 has outer surface 36 and top weight block member 23 is mounted adjacent to outer surface 36. Annular-like weight block 22 has an outer radius R. Top weight block member 23 is an annular segment having a center coincident with center 16 of spherical mass 12 and in which top weight block 23 has an inner radius R' substantially equal to outer radius R of annular-like weight block member 22. Annular-like weight block member 22 has outer surface 36, and annular-like segment of top weight block 23 is located adjacent outer surface 36.

With regard to the embodiment in FIG. 1, bowling ball 10 has spherical mass 12 of a preselected density and a spherical surface 14 equidistant from center 16 of spherical mass 12. The improvement is a weight block assembly of a greater density than the preselected density which comprises annular-like weight block member 18 extending in a direction parallel to a plane of symmetry 38 of annular-like weight block 18, as seen in FIG. 1A, and a top weight block member 19 embedded in annular-like weight block member 18 and having a density greater than the density of annular-like weight block member 18 and having an elongate dimension D extending in a direction transverse to a radius R" of spherical surface 14 and aligned with the plane of symmetry 38 of annular-like weight block member 18. Top weight block member 19 is substantially wedge shaped, as seen in FIGS. 1 and 1A. As can be seen in this embodiment, weight core 28 is surrounded by annular-like weight block member 18 and top weight block member 19 extends radially into the weight core 28. Top weight block member 19 extends substantially to center 16 of spherical mass 12, as seen in FIG. 1.

Annular-like weight block member 18 of this embodiment has a width W, as seen in FIG. 1A measured transversely to plane of symmetry 38 and top weight block member 19 has a width W' which is substantially equal to width W of annular-like weight block 19.

While a detailed description of the preferred embodiments of the invention have been given, it should be appreciated that many variations can be made thereto without departing from the scope of the invention as set forth in the appended claims.

I claim:

1. The bowling ball (10) having a spherical mass (12) of preselected density and a spherical surface (14) equidistant from a center (16) of the spherical mass (12), the improvement being a weight block assembly, comprising:

annular-like weight block member (18) having a plane of symmetry (38), and an elongate dimension extending in a direction parallel to the plane of symmetry (38); and a top weight block member (19) embedded in the annular-like weight block member (18) and having a density greater than that of the annular-like weight block (18) and an elongate dimension (D) extending in a direction transverse to a radius (R") of the spherical surface (14) and aligned with the plane of symmetry (38).

2. The bowling ball (10) of claim 1 in which said top weight block member (19) is substantially wedge shaped.

3. The bowling ball (10) of claim 1 including a core (28) surrounded by the annular-like weight block member (18), and in which the top weight block member (19) extends radially into the weight core (28).

4. The bowling ball (10) of claim 3 in which the top weight block member (19) extends substantially to the center (16) of the spherical mass (12).

5. The bowling ball (10) of claim 1 in which the annular-like weight block member (18) has a width (W) measured transversely to the plane of symmetry (38) and the top weight (19) has a width (W') which is substantially equal to the width (W) of the annular-like weight block (18).

6. The bowling ball (10) of claim 1 in which the top weight block member (19) is located, in part, intermediate the center (16) of the spherical mass (12) and the annular-like weight block member (18).

7. The bowling ball (10) of claim 1 in which the annular-like weight block member (18) surrounds a weight core (28), and said top weight block member (19) is partially imbedded in the weight core (28).

8. The bowling ball (10) of claim 1 in which the top weight block member (19) is wedge shaped.

* * * * *